US007563153B2

(12) United States Patent
Haddadi

(10) Patent No.: US 7,563,153 B2
(45) Date of Patent: Jul. 21, 2009

(54) METHOD OF PREPARING EYEGLASS LENSES FOR MOUNTING ON THE FRAME SELECTED BY THE WEARER

(75) Inventor: Ahmed Haddadi, Charenton le Pont (FR)

(73) Assignee: Essilor International, Charenton-le-Pont (FR)

( * ) Notice: Subject to any disclaimer, the term of this patent is extended or adjusted under 35 U.S.C. 154(b) by 0 days.

(21) Appl. No.: 11/844,367

(22) Filed: Aug. 24, 2007

(65) Prior Publication Data

US 2008/0055542 A1 Mar. 6, 2008

(30) Foreign Application Priority Data

Aug. 29, 2006 (FR) ..... 06 07574

(51) Int. Cl.
*B24B 49/00* (2006.01)

(52) U.S. Cl. ..... 451/8; 451/42; 451/43; 451/390

(58) Field of Classification Search ..... None
See application file for complete search history.

(56) References Cited

U.S. PATENT DOCUMENTS 7,066,797 B2 6/2006 Volken et al.

FOREIGN PATENT DOCUMENTS

EP 1 593 458 11/2005
FR 2878972 6/2006
JP 2003267527 A * 9/2003
WO 03/018253 3/2003
WO 2006/061473 6/2006

* cited by examiner

*Primary Examiner*—Maurina Rachuba
(74) *Attorney, Agent, or Firm*—Young & Thompson

(57) ABSTRACT

The method comprises the following steps:

a centering step during which the optical frame of reference of the lens is acquired and a blocking accessory is fastened thereto; and a step of shaping the lens to have a desired outline.

The blocking accessory is fitted with an electronic identification element bearing an identification code, and said identification code of the electronic element is read initially during a first read during the centering step to associate the code in memory with the mounting parameters of the lens that is receiving the blocking accessory, and then during a second read during the shaping step in order to recover the mounting parameters associated with the identification code as read and thus with the lens attached to the blocking accessory.

11 Claims, 8 Drawing Sheets

METHOD OF PREPARING EYEGLASS LENSES FOR MOUNTING ON THE FRAME SELECTED BY THE WEARER

TECHNICAL FIELD TO WHICH THE INVENTION RELATES

The present invention relates in general to mounting ophthalmic lenses of a pair of correcting eyeglasses on a frame, and it relates more particularly to a method and to apparatus for preparing the lenses of a pair of eyeglasses for mounting on the frame selected by the wearer.

TECHNOLOGICAL BACKGROUND

The technical portion of an optician's profession consists in mounting a pair of ophthalmic lenses in or on the frame selected by the wearer, in such a manner that each lens is properly positioned relative to the corresponding eye of the wearer so as to perform as well as possible the optical function for which it is designed.

In order to mount a pair of ophthalmic lenses, the optician or operator needs in particular to proceed with shaping each of the lenses on the basis of optical, geometrical, and morphological order data. Shaping a lens consists in modifying the outline of the lens so that it fits the selected frame and/or the desired lens shape.

In order to perform such shaping, it is necessary to perform a certain number of operations using a lens-preparation device. Known lens-preparation devices comprise firstly a computer on which recording software is installed for recording lens order data, and secondly a set of treatment appliances for treating lenses including amongst others an appliance for centering lenses and a shaper machine.

The geometrical order data includes the shape desired for the lens after shaping. The desired shape is defined digitally using an appliance specially designed for reading the internal outline of the rim of the frame or the outline of a lens template, or indeed an electronic file that has been prerecorded or supplied by the manufacturer. This shape information is recorded in turn in the recording software.

After selecting the frame, the operator needs to situate the position of each eye in the frame of reference of the frame. The operator places the frame selected by the wearer on the wearer's nose and takes several measurements. These measurements provide data relating to the morphology of the wearer. The operator thus determines mainly two parameters known as centering parameters associated with the morphology of the wearer, specifically the pupillary distance and also the pupil height relative to the frame. The operator inputs this morphological mounting information by using the recording software.

When ordering a pair of lenses (also referred to as a "job") associated with the wearer, the operator uses the recording software to input appropriate order data, i.e. the optical order data for the two lenses of the future pair. This includes in particular spherical and cylindrical powers, prismatic axes, and where appropriate power addition.

When the operator receives a pair of lenses for which order data has already been recorded in the order data recording software, each appliance in the set of treatment appliances needs to be informed which received pair of lenses is to be treated so that it can recover the recorded order data for the lens that is to be treated.

For this purpose, the order data recording software can print out a sheet summarizing the main elements of the order (customer name, optical characteristics of the prescription, etc. . . . ) together with a bar code for identifying the pair of lenses. After preparing an order for a pair of lenses, the operator places the frame and the sheet provided with the identification bar code for that pair of lenses in a tray, while waiting to receive the pair of lenses that has been ordered.

On receiving the pair of lenses to be treated the operator uses a bar code reader associated with the centering appliance to read the bar code on the printed sheet. This operation then enables the order data essential for centering the lens to be recovered, i.e. essential for causing the geometrical frame of reference of the lens to coincide with the position of the pupil so that the characteristic points and directions are properly positioned in the frame. Thereafter, the operator blocks the lens by placing a sticky gripper accessory thereon to mark physically the center of the frame of reference of the lens.

Thereafter, the operator reads the bar code of the printed sheet using a bar code reader associated with the shaper machine so that the computer can deliver to that machine the geometrical data representative of the shape of the outline for each of the right and left lenses.

Such a configuration requires the operator to perform handling that is awkward since the operator must first identify the sheet that corresponds to the order for the pair of lenses that has been received, and must then scan the bar code of the printed sheet in order to be able to select said pair of lenses (or job) and enable the treatment appliance in question to receive the order data corresponding to the selected pair of lenses. Such manipulation is time consuming and can be a source of errors. In particular, during shaping, the operator might well interchange the left and right lenses. The operator also depends on the tray without which the lens cannot be identified, and confusion can arise in particular between two lenses or two jobs. It can thus happen that the operator selects a blocking accessory that is not suitable for the lens that is to be shaped.

The above solution requires bar code reader means, thereby increasing the cost of the device for treating the pair of lenses. Furthermore, the use of printed identification sheets that can be read by the operator prevents the treatment of the lenses being automated.

OBJECT OF THE INVENTION

The object of the present invention is to simplify preparing lenses for mounting in a frame while limiting possible errors in the handling of the lenses by the operator.

To this end, the invention provides a method of preparing eyeglass lenses for mounting in the frame selected by the wearer, taking account of stored mounting parameters associated with the morphology of the wearer and with the shape of the frame, the method comprising the following steps:

- a "centering" first step during which the optical frame of reference of the lens is acquired and a blocking accessory is appropriately positioned in the optical frame of reference of the lens; and
- a second step of shaping the lens to have a desired outline in a frame of reference associated with the blocking accessory and thus the optical frame of reference of the lens, with account being taken of the mounting parameters.

The blocking accessory is fitted with an electronic identification element bearing an identification code, and said identification code of the electronic element is read initially during a first read during the centering step to associate the code in memory with the mounting parameters of the lens that is receiving the blocking accessory, and then during a second read during the shaping step in order to recover the mounting parameters associated with the identification code as read and thus with the lens attached to the blocking accessory.

The lens for treatment is thus identified by the identification code of the electronic element fitted to the blocking accessory. Once the blocking accessory has been fixed on the lens, the lens can be identified throughout its preparation for mounting, by passing the lens fitted with its blocking accessory into the read field of the identification code reader.

Lens identification is easy and can be automated since the electronic element including the identification code is attached to the lens by the blocking accessory. In addition, the scope for handling error by the operator is limited.

Advantageously, said electronic element is a radio frequency identification element.

The use of a radio frequency identification element enables the lens to be identified when it is situated in the read field of the identification code reader without it being necessary to take precautions concerning the geometrical configuration of the lens relative to the reader or the cleanliness or the optical legibility thereof. This simplifies lens identification.

According to another characteristic of the invention, said characteristic of the blocking accessory advantageously includes a dimension of said blocking accessory.

It is thus possible to verify that the selected blocking accessory is compatible with the lens to be treated. It is possible in particular to verify that the size of the blocking accessory enables it to be applied to the lens far enough away from the outline desired for the lens to allow the lens to be cut to shape. It is also verified that the blocking accessory is large enough to provide a contact area that is sufficient to prevent the lens from slipping while it is being cut to shape.

DETAILED DESCRIPTION OF AN EMBODIMENT

The following description with reference to the accompanying drawings of an embodiment, given by way of non-limiting example, serves to show what the invention consists in and how it can be embodied.

Figure 5:
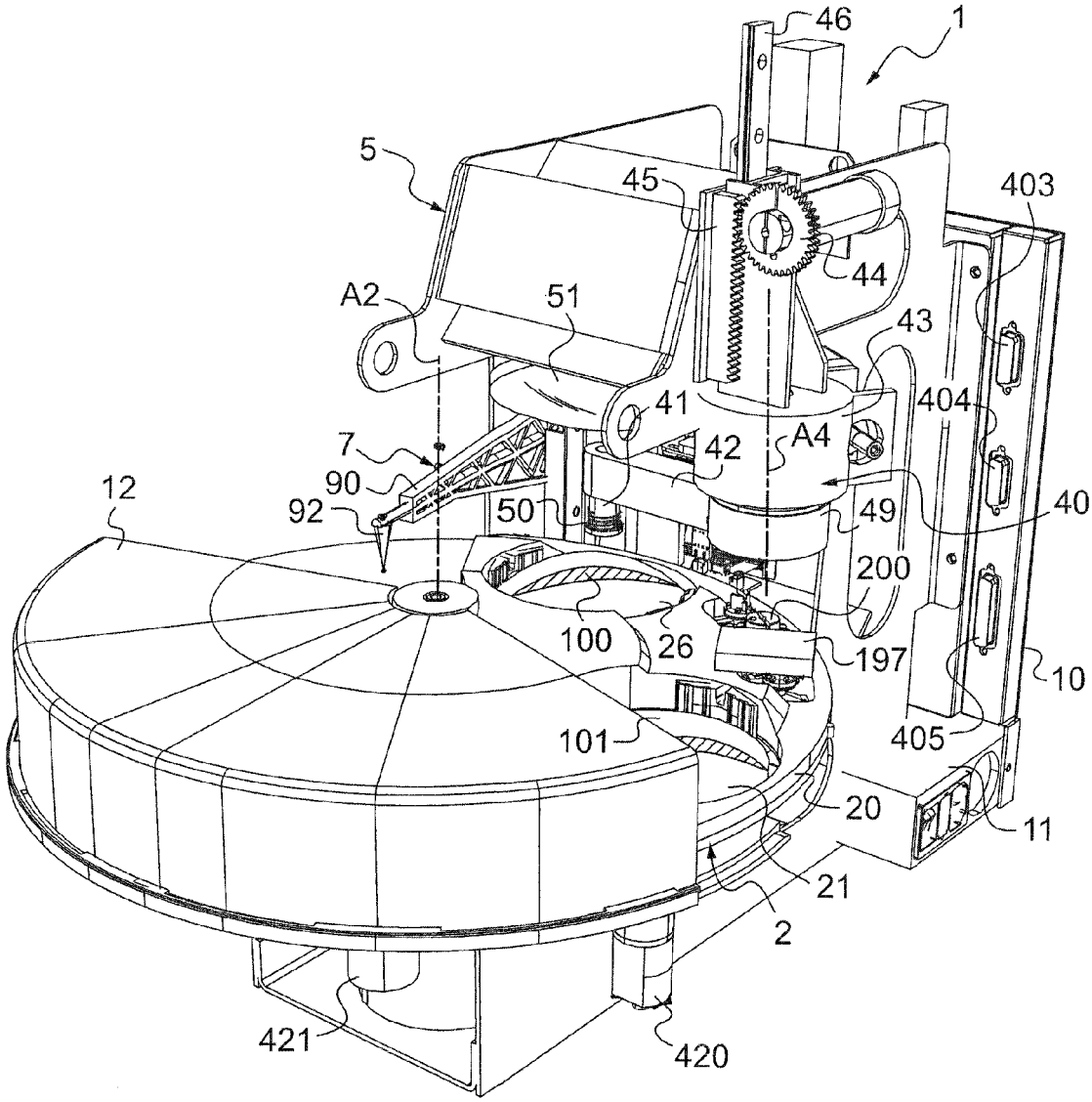
FIG. 5 is a perspective view of the inside of the centering and blocking device in a configuration of the carousel in which one of the lenses is positioned under the blocking device to receive one of the blocking accessories.
Figure 6:
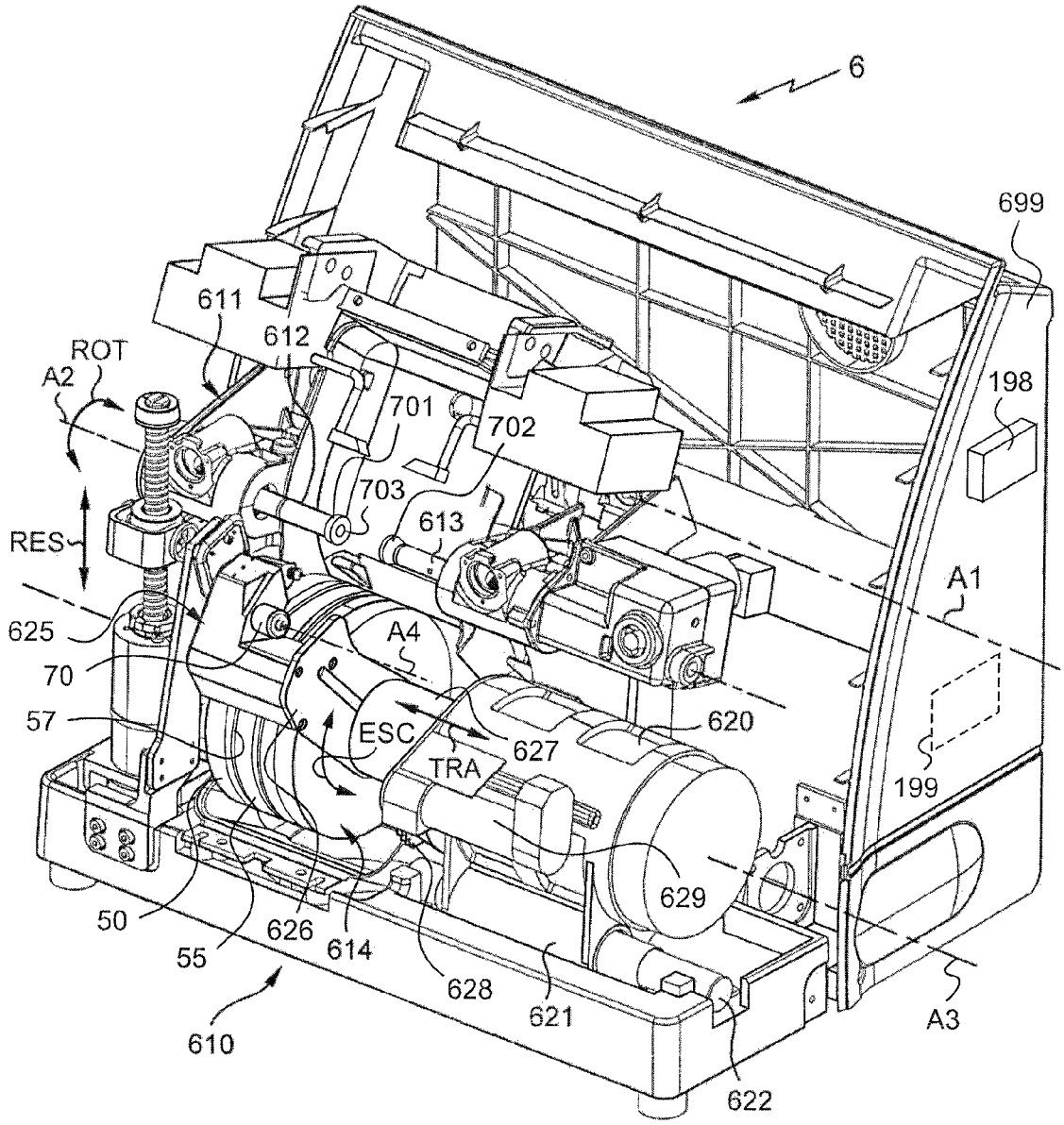
FIG. 6 is an overall perspective view of a shaper device of the preparation device.

The device of the present invention for preparing lenses for mounting mainly comprises two subassemblies mounted on a common frame (not shown): a centering and blocking device 1 for centering and blocking lenses (FIGS. 1 to 5), also referred to as a locator-blocker device, and a shaper device 6 (FIG. 6)

The locator-blocker device 1 comprises a plurality of appliances mounted on a common frame 10:

- a carousel 20 designed and arranged to receive a pair of lenses 100, 101 and to cause them to pass through a plurality of positions;
- a measuring device 5 for automatically measuring various optical and geometrical characteristics of the lenses 100, 101 (which may, for example, be single-vision, multifocal with near or intermediate vision segments presenting power discontinuities, or indeed multifocal with power being added progressively);
- feeler means 7 designed and arranged to feel each ophthalmic lens being prepared;
- a hood 500 enclosing the assembly to protect it and possessing a door 12 giving restricted access; and
- a liquid crystal display (LCD) type screen 300.

Provision is made for the preparation device also to include a plurality of blocking accessories 200, 201, 203, 204 suitable for being applied to a face of a lens, specifically its convex face, to mark and conserve a centering reference thereon.

Blocking Accessories

The blocking accessories 200, 201, 203, 204 comprise large-diameter accessories 200, 201 and small-diameter accessories 203, 204. These blocking accessories are also commonly referred to as pads or holder blocks.

In each blocking accessory 200, 201, 203, 204 there is implanted a radio frequency identification element 220, commonly referred to as an RFID.

To summarize, radio frequency identification is a method of storing and remotely retrieving data relating to an article by using an RFID element implanted in the article. Such RFID elements comprise an antenna associated with an electronic chip, thereby enabling them to be powered electrically by the wave flux and to receive and respond to radio requests emitted by a radio frequency identification code reader, referred to as an RFID reader. The RFID reader may also be designed to write data in the RFID element.

The locator-blocker device thus makes use of an RFID reader that acquires the identification data of the RFID element when it is placed in a given space around said appliance.

In this example, the RFID elements 220 are in the form of small cast resin capsules of diameter much smaller than the diameter of the corresponding blocking accessory. The identification data or code of the RFID element is constituted by a single, non-modifiable 64-bit number. In a variant, the RFID elements could also be in the form of toruses.

Figure 7:
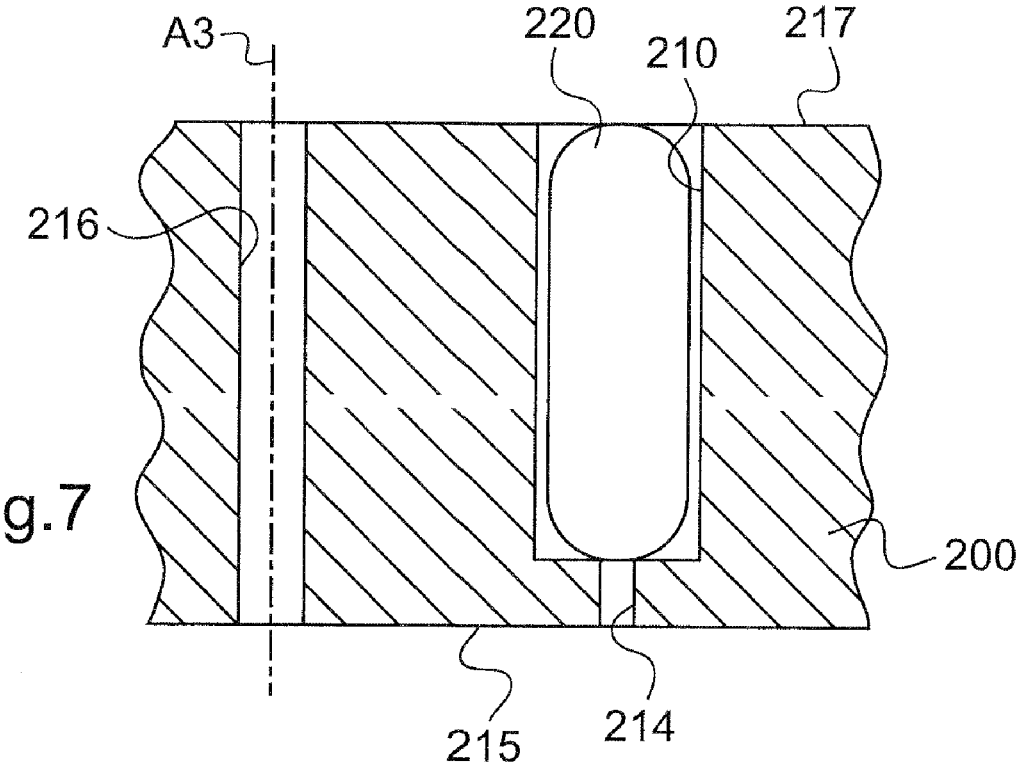
FIG. 7 is a detail view in section of the blocking accessory in which a radio frequency identification element is mounted.
Figure 8:
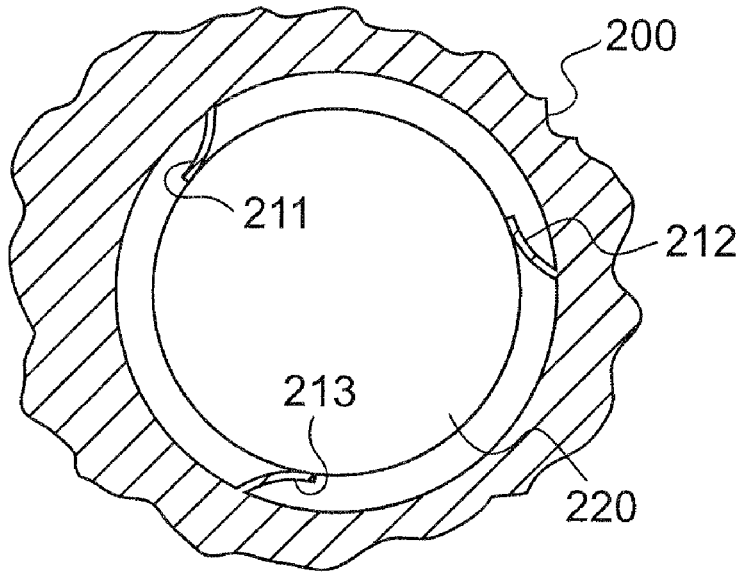
FIG. 8 is a detail plan view of the portion of the blocking accessory shown in FIG. 7 and of the radio frequency identification element.

As shown in FIG. 7, the RFID element 220 is housed in a cylindrical opening 210 formed in the corresponding blocking accessory 200. This cylindrical opening 210 presents a diameter that is slightly greater than that of the RFID element 220. The RFID element 220 is held in the cylindrical opening 210 by three tongues 211, 212, 213 that are attached to the wall of the cylindrical opening 210 and that are distributed at substantially 120° from one another about the center of the opening (see FIG. 8). In addition, these tongues 211, 212, 213 are designed to bear against the side wall of the RFID element, all of them bending in the same direction.

For reasons of cost, the RFID element is removable from the blocking accessory. For this purpose, a small diameter extraction hole 214 is provided opening into the bearing surface 215 of the blocking accessory and into the bottom of the housing 110 in the RFID element. This extraction hole 214 enables the RFID element to be extracted (see FIG. 7) by being expelled by inserting a pin of the drift-punch type into the extraction hole. The housing 210 of the RFID element is offset relative to the central axis A3 of the blocking accessory 200, thus enabling a central orifice 216 to be provided that is centered on the central axis A3 and that passes right through the blocking accessory used for gripping the accessory so as to enable a centering mark, if any, formed on the lens to be read through said orifice 216.

Carousel

Figure 2:
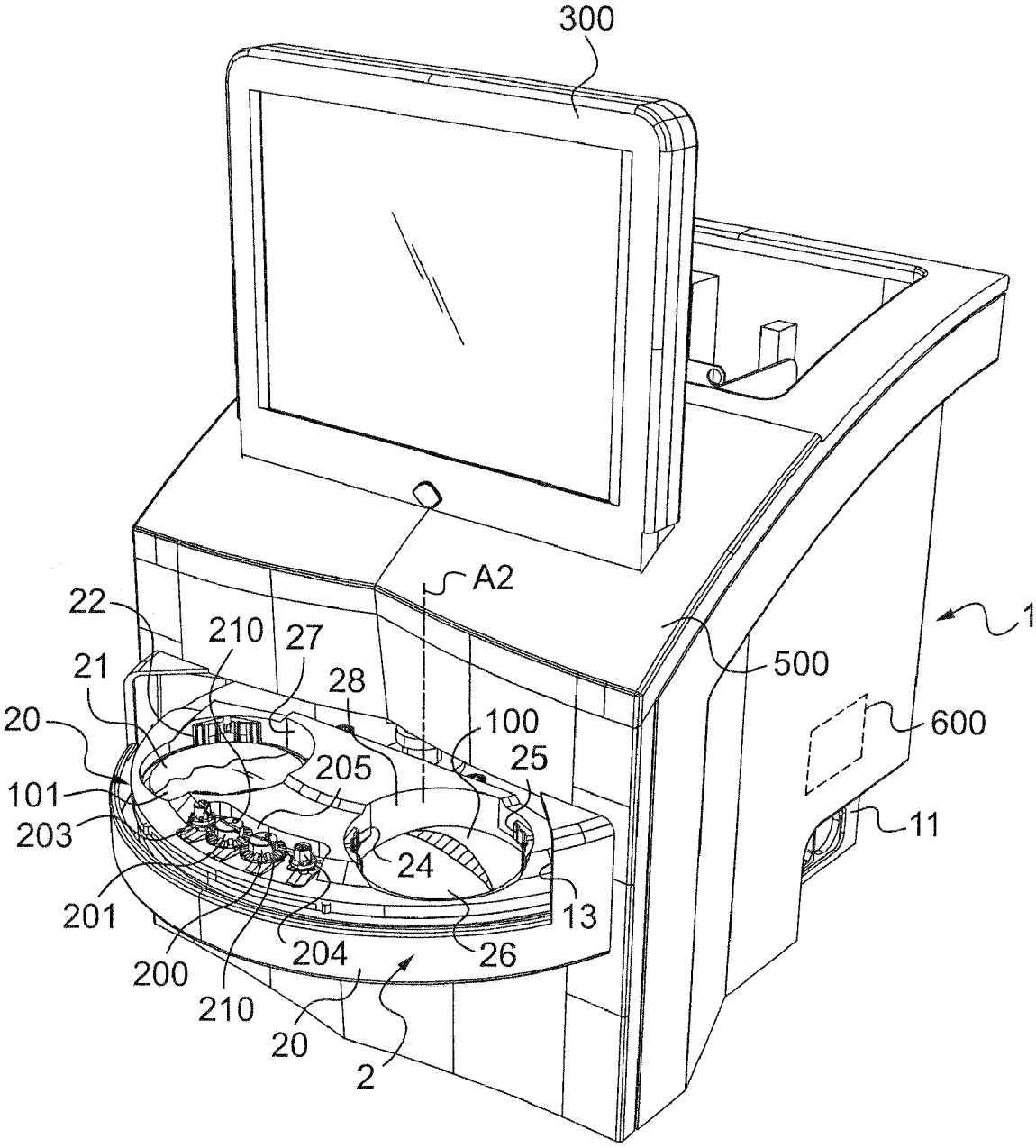
FIG. 2 is a view similar to FIG. 1 with an access door of the hood opened to enable a pair of lenses and blocking accessories to be loaded and unloaded into and from the carousel.

As shown more particularly in FIG. 2, the carousel 2 comprises:

- a loading and unloading turntable 20 mounted on the common frame 10 of the locator-blocker device 1 to turn about an axis of rotation A2 passing substantially through its center and perpendicularly to the plane of the turntable;
- on the loading and unloading turntable 20, two housings 27, 28 each suitable for receiving a respective lens 100, 101;
- two seats 21, 26 for loading and unloading the lenses 100 and 101; and
- holder means 22 to 25 for holding the lenses 100 and 101 stationary when loaded on the turntable 20.

Figure 1:
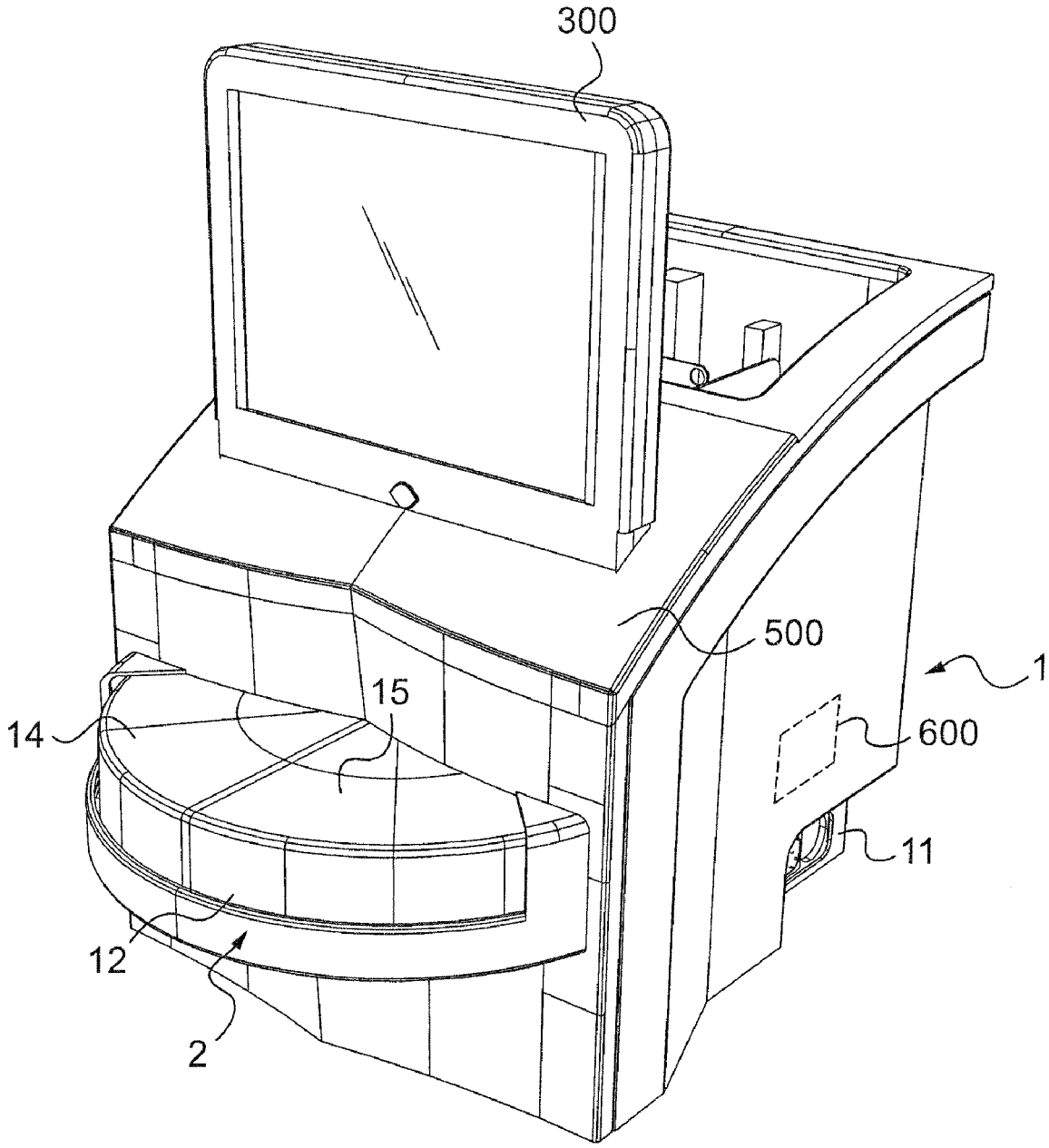
FIG. 1 is an overall perspective view showing the outside of a centering and blocking device of the preparation device, provided with a hood.

As shown in FIGS. 1 and 2, access to the loading and unloading turntable 20 of the carousel 2 is restricted by an access door 12. This access door 12 is constituted by two sectors 14, 15 that can pivot in opposite directions to reveal an opening 13 enabling lenses to be loaded and unloaded.

In the example shown, the housings 27, 28 for the two lenses are constituted by recesses, each substantially circular in shape and of diameter that is slightly greater than the standard diameter (about 70 mm) of lenses 100 and 101 that are to be cut to shape.

Figure 3:
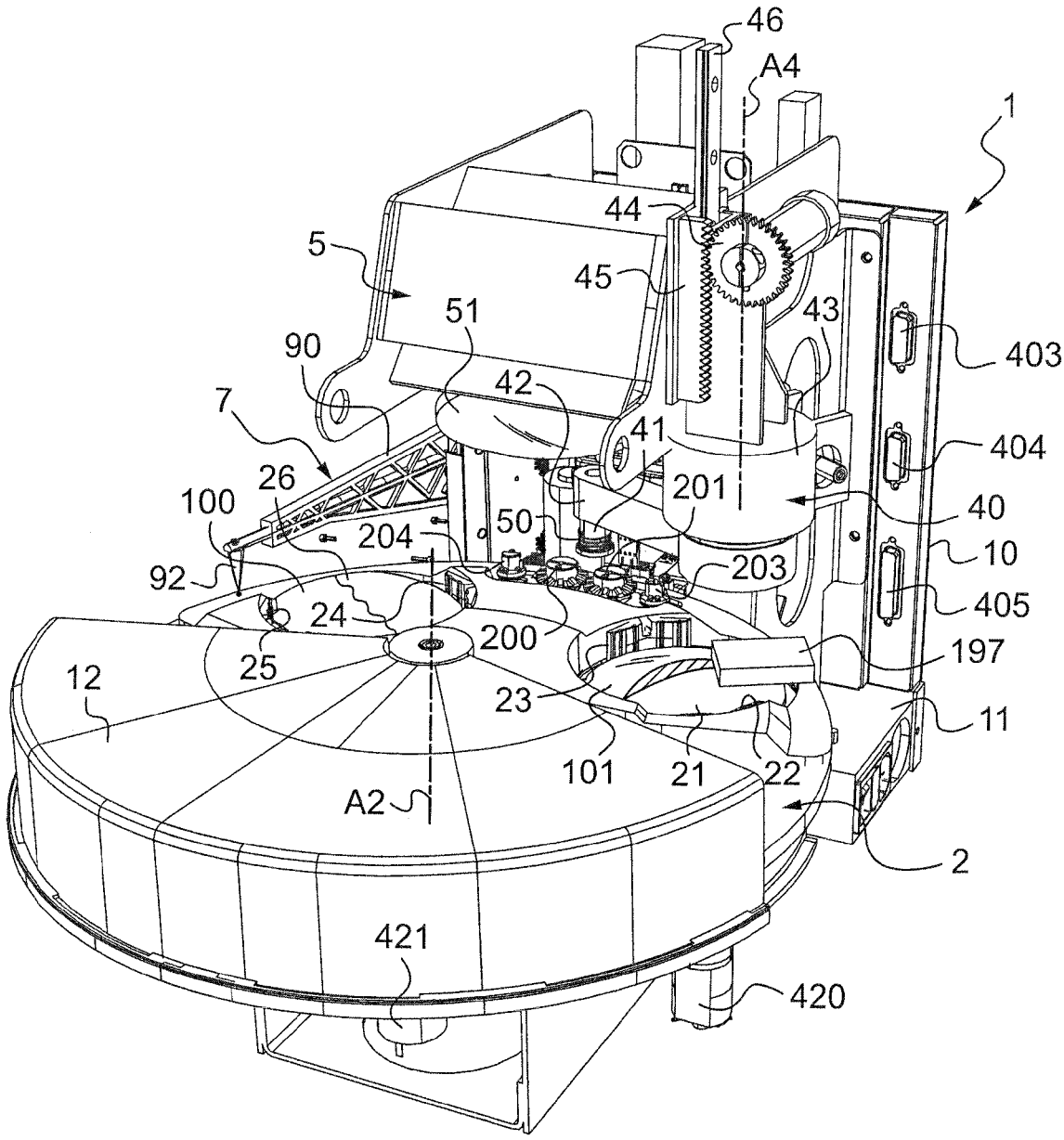
FIG. 3 is a perspective view from the inside of the centering blocking device in a configuration of the carousel in which one of the blocking accessories can be taken by the gripper head of a blocking device.

Provision is made in each circular housing 27, 28 for two diametrically-opposite clamping jaws 22 to 25 to constitute the lens holder means (FIGS. 1 and 3). These jaws are provided with hinged, generally V-shaped fingers capable of moving towards each other in a closed position or apart from each other in an open position. Each of these jaws is arranged facing the center of the corresponding housing. The clamping jaws 22 to 25 are mounted in the carousel 2 in such a manner that when the turntable 20 turns, the clamping jaws 22 to 25 turn with the turntable 20 so as to remain facing the center of the corresponding housing.

The clamping jaws 22 to 25 are urged towards the closed position by a resilient element such as a return spring (not shown). Furthermore, the jaws are driven into an open position by a particular drive mechanism (not shown) controlled by an electric motor 421.

The seats 21, 26 are disposed laterally under the turntable and each is substantially circular in shape, having a diameter that is slightly smaller than that of the housings. The seats are mounted stationary relative to the frame 10 such that when the turntable is brought into the lens loading and unloading position, the housings 27, 28 are in register with the seats 21, 26. In this loading and unloading configuration, the lenses are thus carried by the seats. In the other configurations of the turntable, the lenses are held laterally by the clamping jaws 22 to 25.

Housings 205 are also provided for the blocking accessories 200, 201, 203, 204.

Measuring Device

The measuring device 5 has two main functions. Its first function consists in measuring the local optical powers of a lens at remarkable points thereof.

Its second function consists in detecting and locating centering or identification characteristics of the lens in order to suitably position or place the lens in an overall frame of reference known to the device. When an ophthalmic lens is mounted in a frame, it is important for the visual comfort of the wearer to ensure that the lens is properly positioned relative to the eye for which it is to correct a defect of refraction or of accommodation.

Overall, an ophthalmic lens is centered when the optical center (for single-vision lenses or multifocal lenses with a power discontinuity), or the reference center (for progressive lenses) of the ophthalmic lens as specified during its design, coincides with the center of the pupil of the eye, or put another way, when the line of sight passes through the optical center or the reference center of the ophthalmic lens. Centering is thus the result of causing two geometrical-optical features to come together: the pupil morphology of the wearer and the position on the lens of its optical center or its reference center. In order to exercise the desired optical function, the lens must also be appropriately oriented about its optical center.

The measurement device may be of any type whereby the lens is presented between lighting means 51 and analysis means (not shown) in order to obtain an overall measurement of one or more of its optical characteristics at a plurality of points over the major portion of its extent. The overall optical measurement may be obtained by deflection measurement (of the Hartmann, moire, etc.) type, by interference measurement, by wave propagation, etc. The user interface can then display not only the optical center or the reference center, but also power maps, and/or powers, and/or axis orientations at one or more remarkable points of the lens.

An example of a measurement device is described in detail in the patent application filed on Dec. 3, 2004 under the number FR 04/12848 in the name of the Applicant.

Blocking Device

It should be recalled that the optical center of a lens is the point where there is no prismatic deformation of the image. The optical axis is the axis perpendicular to the plane of the lens passing through the optical center.

A point is also defined for gripping and blocking the lens on which blocking is to be performed. This point is selected to coincide with the so-called "boxing center" well known to the person skilled in the art, which is the point of intersection of the diagonals of the rectangle circumscribing the shape of the outline desired for the lens after it has been cut, this rectangle having horizontal and vertical sides in the wearing configuration shape (defining the horizontal). The boxing center is determined by the measurement device 5 as a function of the identification characteristics measured on the lens and as a function of the morphological parameters of the wearer and as a function of the geometry of the selected frame. For one of the two main faces of the lens, specifically the convex front face, a docking and blocking axis is defined that is referred to as the "boxing" axis and it is the axis that is substantially normal to the surface of the face concerned of said lens that passes through the boxing center.

The blocking device 40 is designed and arranged to dock one of the blocking accessories against one of the two main faces of said lens (specifically the convex front face) by moving the blocking accessory in translation relative to the lens along the boxing axis associated with said face. The blocking accessory is pressed against the convex front face by being moved in translation along the docking direction, while being held rigidly during said movement in translation.

Figure 9:
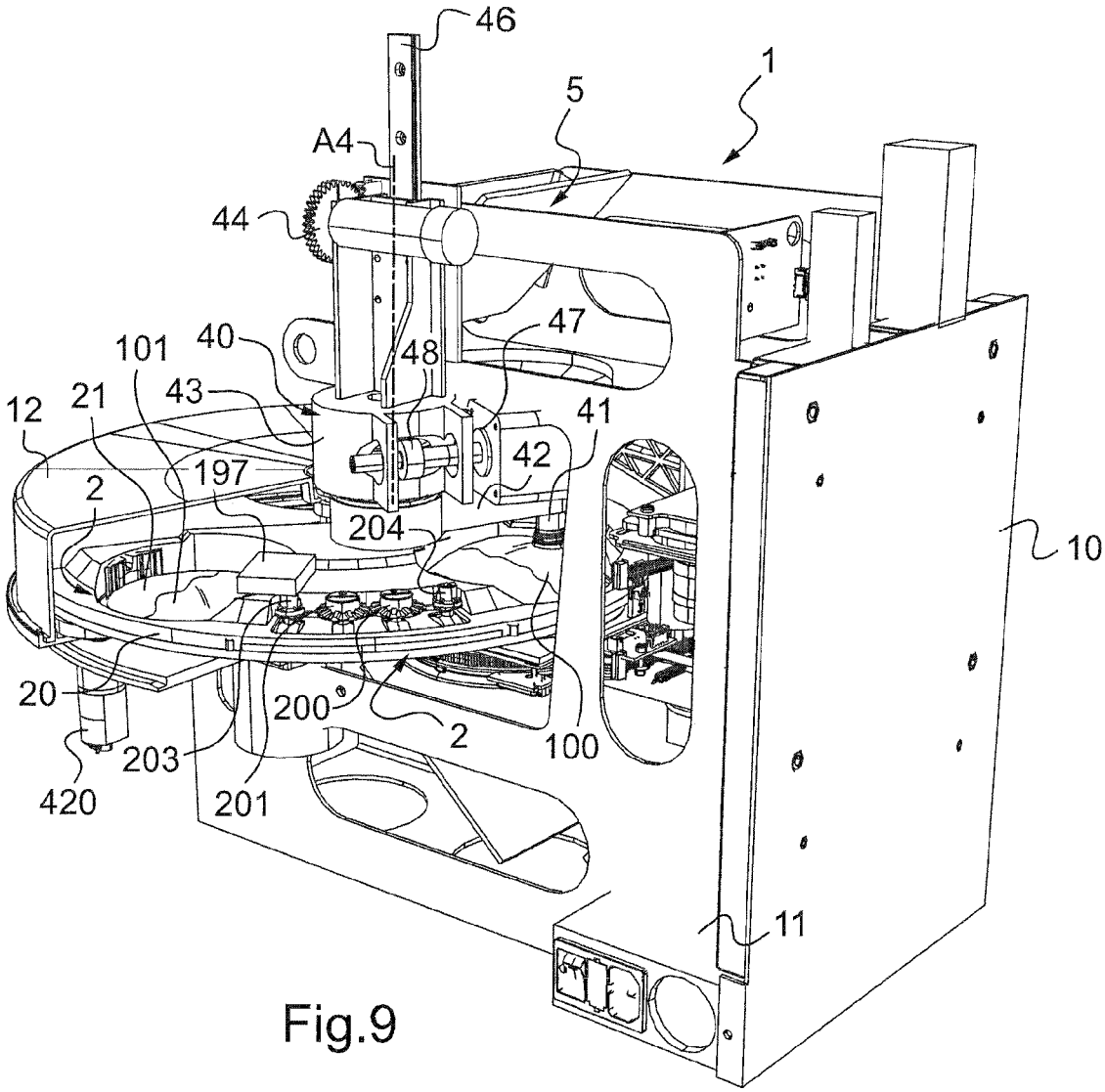
FIG. 9 is a perspective view of the inside of the centering and blocking device in a configuration of the carousel in which the blocking accessories can be identified by radio frequency.

As shown more particularly in FIGS. 3, 5, and 9, the blocking device 40 comprises a top body 43 of substantially cylindrical shape about an axis A4, and a bottom body 49. The bottom body 49 presents a cylindrical portion centered on the axis A4 and an arm 42 attached to the side face of the cylindrical portion of the bottom body 49. The arm 42 is of rectilinear shape and extends transversely relative to the axis of rotation A4, i.e. in a horizontal plane in the configuration in which the automatic centering device is used.

The bottom body 49 is mounted to rotate about the axis A4 thus enabling the arm 42 to pivot about the axis A4. The bottom body 49 is turned by an electric motor 47 (FIG. 9) acting via a set of gears 48.

A cylindrical sleeve 41 is secured to the free end of the arm 42 and extends vertically downwardly, i.e. towards the carousel. This cylindrical sleeve 41 presents a head 50 that constitutes means for gripping and placing one of the accessories 200, 201, 203, 204 on the lens. The head 50 possesses a housing (not shown) for receiving the gripper shank 217 of the blocking accessory. In order to hold the blocking accessory in temporary manner, the housing is provided with a spring for clamping on the shank, or in a variant, with a permanent magnet that co-operates with a metal insert (that may be constituted by the RFID element 200) fitted to the shank of the blocking accessory.

The blocking device also possesses rest means for putting the arm 42 at rest. These rest means may be of the same type as are used for putting a record player arm at rest, having a seat for retaining the arm in a high position, on which the arm is brought to bear after being pivoted in its high position to an angular rest position. Provision is also made for a clamp to hold the arm in its rest position, by pressing against the high abutment.

Finally, the blocking device 40 can be moved as a whole in translation along a guide rail 46 that extends in a direction parallel to the axis A4. Displacement in translation along the axis A4 is implemented by means of a mechanical system comprising a toothed wheel 44 that meshes with a plate 45 having notches in its rim and disposed vertically, i.e. in a direction parallel to the axis A4.

Feeler Means

Figure 4:
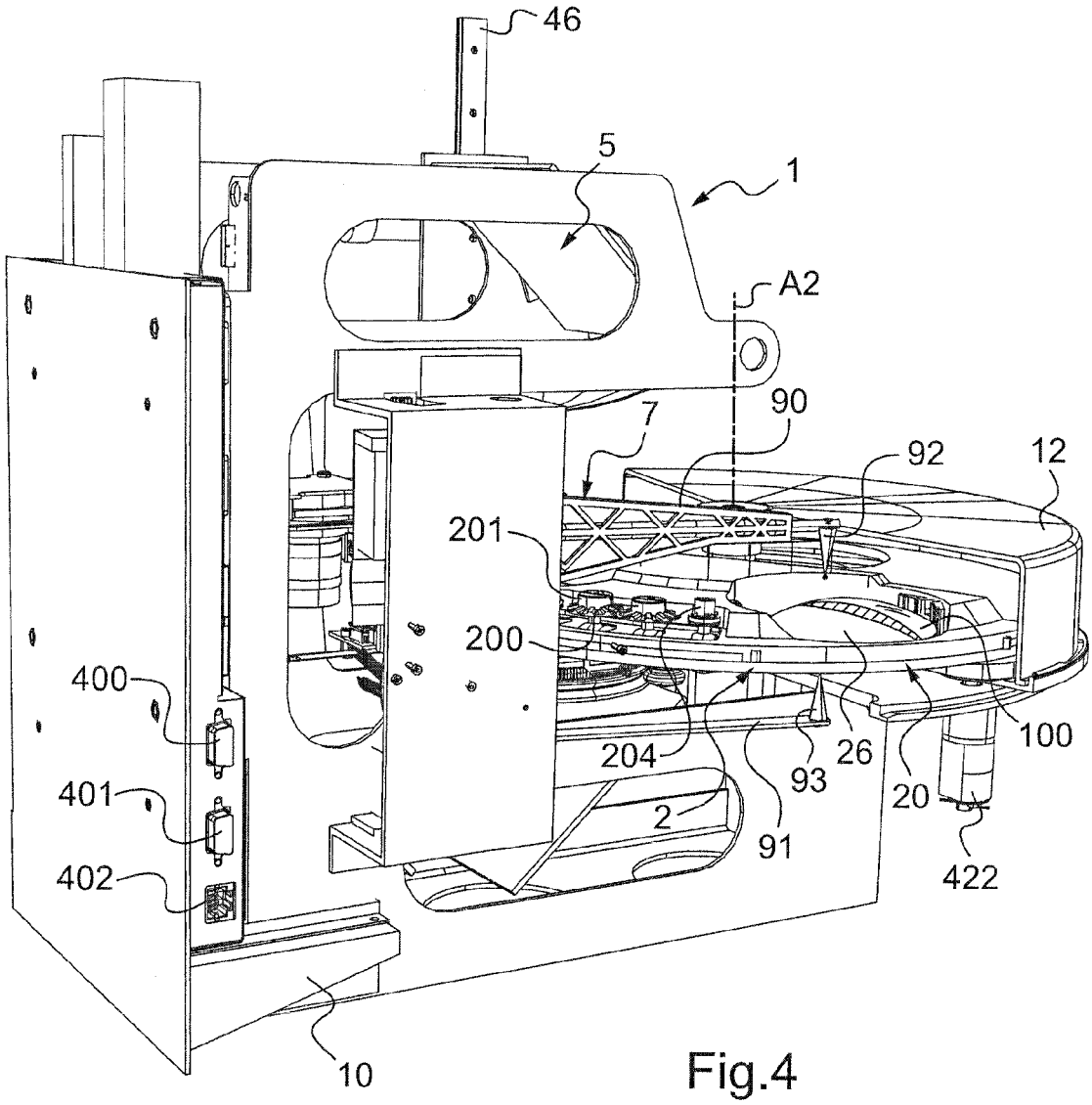
FIG. 4 is a perspective view of the inside of the centering and blocking device in a configuration of the carousel in which one of the lenses is ready to be felt by the feeler means.

As shown in FIG. 4, the feeler means 7 are arranged to feel the two main faces (front or convex and rear or concave) of the lenses 100, 101, either independently or conjointly. For this purpose, the feeler means 7 comprise two branches 90 and 91 that are substantially rectilinear, each terminating in a bent free end forming a feeler finger 92, 93. The two fingers 92, 93 of the two branches 90, 91 point towards each other so as to be brought into contact with the front and rear faces, respectively. Each of the fingers 92 and 93 carries conventional mechanical feelers that operate merely by mechanical contact.

One and/or the other of the two branches 90 and 91, and specifically both branches 90 and 91 can be moved in translation. This movement in translation enables the two fingers 92, 93 to be moved apart or towards each other. The movements in translation of the branches 91, 92 are controlled independently of each other by encoding electric motors (not shown).

Controlling Electronic and Computer Unit

The locator-blocker device 1 includes a controlling electronic and computer unit 600 constituted in this example by an electronic card designed to coordinate the various appliances of the locator-blocker device 1 for mounting purposes, such as the carousel, the measuring device, the feeler means, and the blocking device, in application of an automated treatment method that is explained below.

For example, the electronic and computer unit 600 comprises in conventional manner a mother card, a microprocessor, random access memory, and permanent mass memory. The mass memory contains a program for executing the automatic method of preparing lenses for mounting in accordance with the invention as described below. The mass memory is preferably rewritable and is advantageously removable in order to enable it to be replaced rapidly or programmed on a remote computer via a standard interface.

Communication means are also provided for communicating with a microcomputer (not shown) that executes software for recording order data for each pair of lenses. Amongst other things, the order data includes morphological data concerning the wearer, geometrical data concerning the shape desired for the outline of each lens, and prescription data such as the optical characteristics of the lenses to be treated.

The mass memory of the electronic and computer unit 600 hosts a computer register of lenses in which each record is associated with a lens or the pair to which the lens belongs and includes a field making it possible during the treatment method described below, to store an individual code identifying the electronic element fitted to a blocking accessory. Each lens record is also associated with parameters for mounting the lens in association with the morphology of the wearer and the shape of the frame. The electronic and computer treatment unit 600 is designed, during the preparation method, to deliver to said register the control data for each pair of lenses via the software for registering control data. A method of delivering data is described in greater detail in the patent application filed on Mar. 6, 2006 under the number FR 06/01953 in the name of the Applicant. The electronic and computer processor unit 600 can thus work freely on its own data without any risk of spoiling the original data recorded in the microcomputer that hosts the recording software.

Provision is also made for the electronic and processor unit 600 of the locator-blocker device 1 to include a computer register in which each record is associated with a blocking accessory and contains identification data of the RFID element associated with said accessory and geometrical and/or mechanical data relating to the blocking accessory, such as the diameter of the accessory. Each record in the accessory register also includes a field in which the number of times the accessory has already been used is updated.

The locator-blocker device 1 has a plurality of computer connectors 400, 401, 402, 403, 404, 405 enabling the electronic and computer processor unit 600 to send and receive data. In particular, a network connector 402 is provided together with serial connectors 400, 401, 403, 404, 405, including in particular one or more USB connectors designed to receive one or more USB keys incorporating the mass memory of the electronic and computer processor unit 600 of the centering and blocking device 1. All or part of the mass memory is then easily removable to be put into a safe place or replaceable for updating the internal program.

Finally, the preparation device includes a power supply unit 11 that feeds electricity to the various members of the locator-blocker device 1 such as the electric motors and the electronic and computer processor unit 600.

Shaper Device 6

FIG. 6 shows a digital shaper device 6 adapted to modify the outline of the ophthalmic lens in order to fit it within the rim of a selected frame.

The device comprises a rocker 611 that is mounted on a frame to pivot freely about a free axis A1, in practice a horizontal axis. In order to hold and turn an ophthalmic lens for machining, the rocker 611 is fitted with support means suitable for clamping and turning the ophthalmic lens 100, 101. These support means or holder means comprise two clamping and rotary drive shafts 612, 613. These two shafts 612, 613 are in alignment with each other along a second axis A2 referred to as the blocking axis, running parallel to the axis A1. The two shafts 612, 613 are rotated synchronously by a motor (not shown) via a common drive mechanism (not shown) on board the rocker 611.

In the description below, attention is given to one lens, in this case the lens 100, and to one blocking accessory, in this case the blocking accessory 200, which is glued to the convex face of the lens 100 in order to conserve its frame of reference. Naturally, the description below also applies to the lens 101.

Each of the shafts 612, 613 has a free end that faces the other shaft and that is designed to receive a blocking chuck 701, 702 for blocking the lens on the shaft 612, 613. The two chucks 701, 702 are generally bodies of revolution about the axis A2, each presenting a generally transverse bearing face arranged to bear against the corresponding face of the lens. Specifically, one of the chucks 701 is applied against the convex front face of the lens 100 and the other chuck 702 is applied against the rear face of the lens 100 so as to hold the lens clamped between the two chucks and so as to enable it to be turned. The bearing faces of the chucks are suitable for cooperating by friction with the lens so as to prevent it from moving.

The chuck 701 that is applied against the convex front face of the lens 100 is designed to receive the blocking accessory 200 that is stuck onto the lens 100. For this purpose, a housing 703 is formed in the chuck 701. This housing 703 opens out into the application face of the chuck 701.

To index rotation of the chuck 701 relative to the blocking accessory 200, the housing is of a shape that is not circularly symmetrical, for example it is oval. The blocking accessory 200 presents an outside shape that is complementary to the housing in the chuck 701 so as to be received snugly in said housing. The housing 703 is also designed to receive the blocking accessory 200 so that the application surface of the blocking accessory 200 is flush with the application surface of the chuck 701.

The shaft 613 is movable in translation along the blocking axis A2, facing the other shaft 612 so as to clamp the lens in axial compression between the two blocking chucks. The shaft 613 is moved in axial translation by a drive motor via an actuator mechanism (not shown). The other shaft 612 is stationary in translation along the blocking axis A2.

The shaper device 6 includes a grinder 610 having a set of several grindwheels 614 mounted on a third axis A3 in order to blank out and finish the edging of the ophthalmic lens 100 to be machined.

As shown diagrammatically in FIG. 6, the set of grindwheels 614 comprises in particular a blanking grindwheel 50 and a finishing grindwheel 55 centered on the axis A3. The finishing grindwheel 55 includes a beveling groove 57 for beveling the edge of the lens during a finishing step.

The set of grindwheels is fitted onto a common shaft of axis A3 that drives them in rotation during the edging operation. This common shaft, which is not visible in the figures shown, is rotated by an electric motor 620.

The set of grindwheels 614 is also movable in translation along the axis A3 and is moved in this translation under the control of a motor. Specifically, the assembly comprising the set of grindwheels 614, its shaft, and its motor is carried by a carriage 621, itself mounted on slideways 622 secured to the structure to slide along the third axis A3. The movement in translation of the grindwheel-carrier carriage 621 is referred to as "transfer" and it is marked TRA in FIG. 6. This transfer is controlled by a motor-driven drive mechanism (not shown) such as a screw-and-nut system or a rack.

In order to enable the spacing between the axis A3 of the grindwheel 614 and the axis A2 of the lens during edging to be adjusted dynamically, use is made of the ability of the rocker 611 to pivot about the axis A1. This pivoting produces substantially vertical displacement of the lens 100 clamped between the shafts 612, 613 so that the lens moves towards or away from the grindwheels 613. This movement that serves to define the desired shape for the edging (or cutting) is referred to as reproduction and is marked RES.

Finally, the grinder 610 is protected by a cover 699. An RFID reader 198 is disposed outside the grinder 610 on the cover 699.

The shaper device 6 includes an electronic and computer processor unit 199 for controlling the various members and constituted in this example by an electronic card designed to coordinate the various movements of the working tools and the lens clamping and rotary drive means so that all of the points of the outline of the lens 100 are brought in succession to the desired radius.

By way of example, and in conventional manner, the electronic and computer system 199 comprises a mother card, a microprocessor, a random access memory, and a permanent mass memory. The mass memory contains a program for executing the cycle for machining each lens so as to obtain the desired final outline. The mass memory is preferably rewritable and is advantageously removable to enable it to be replaced quickly or programmed on a remote computer via a standard interface.

Computer Network

The electronic and computer processor unit 600 of the locator-blocker device and the electronic and computer processor unit 199 of the shaper device are provided with means for communication via a network architecture. By way of example, these units are provided with electronic cards and software for wired or wireless network communication of the Ethernet or WiFi type. Computer communication can thus be established for up and down transmission of data, and in particular:

- between the electronic and computer processor unit 600 of the locator-blocker device 1 and one or more electronic and computer processor unit 199 of one or more shaper devices;
- between the electronic and computer unit 600 of the locator-blocker device 1 and the microcomputer that hosts the software recording the order data; and between the electronic and computer processor unit 199 of the shaper device and one or more electronic and computer processor units 600 of one or more locator-blocker devices 1.

The electronic and computer processor unit 600 of the locator-blocker device 1 is also programmed to act as a data server making data available to the other equipment present on the network concerning the shapes, the morphologies, and the prescriptions contained in its lens register.

Method of Preparing the Lens for Mounting

The lenses are processed in job. The term "job" covers an associated pair of lenses 100 and 101 both belonging to the same pair of eyeglasses, and consequently both mounted on a single frame to be worn by a wearer.

The processing of a job comprises the following steps.

Preliminary step: Inputting or transmitting the order data applicable to the job In order to be able to mount lenses properly, in a preliminary step, the optician places the frame selected by the wearer on the wearer's nose and takes various morphological measurements of the wearer using an instrument known as a "pupillometer" or any other measuring or imaging instrument. The optician thus establishes in particular the pupillary distance that represents the distance between the two pupils or the pupillary half-distances that represent the distances between each pupil and the center of the nose of the frame worn by the wearer. The optician also identifies height that represents the distance vertically relative to each pupil between the pupils and the bottom edges of the frame worn by the wearer. This height can be measured either using presentation eyeglasses having the frame selected by the wearer and having lenses on which the locations of the wearer's pupils are marked with a felt tip pen and then measured with a ruler, or else by means of a digital system for taking an image and processing the image. This measurement thus incorporates information relating to the shape of the selected frame. It is also possible to measure the pantoscopic angle which corresponds overall to the inclination of the general plane of each lens relative to the vertical.

Furthermore, the optician or operator inputs into the software for recording order data, optical order data constituted by the parameters of the prescription relating to the wearer for which the job being prepared is intended. In particular, this comprises the cylindrical power axes and the prismatic axes and powers, and possibly also cylindrical and spherical power and where appropriate power addition.

Finally, the geometrical order data constituted by information representing the shape desired for the outline of the lens (corresponding to the shape of the selected frame or a predefined lens shape) is also recorded in the software for recording order data. In this example, the pair of lenses 100, 101 is for mounting in a frame having rims. The shape desired for the outline of each lens is obtained using an instrument for reading the outline (not shown) and specially designed to read the outline of the inside of the rim (that goes around the lens) of the frame or the outline of a lens template. This reader instrument has means for communicating with the microcomputer hosting the software for recording order data in order to transmit to the recording software geometrical data concerning the outline desired for each lens. In a variant, provision can be made for the instrument for reading the outline to communicate directly with the electronic and computer system 600 in order to write in the lens register of said system the data concerning the shape desired for the outline of each lens.

Provision can also be made, in a variant or for a pair of lenses for use with a rimless frame (e.g. with holes drilled in the lenses) for the data concerning the desired shape to be obtained from a prerecorded electronic file or a file supplied by the manufacturer.

The electronic and computer processor unit 600 then delivers to the lens register associated therewith the control data for each pair of lenses previously recorded via the order data recording software, as explained above.

Step 1: Presenting the loading and unloading turntable 20 in the loading position Where necessary, the electronic and computer unit 600 causes the loading and unloading turntable 20 to turn so as to present the two housings 27, 28 in the loading position in register with the door 12. As mentioned above, in this loading configuration, the loading housings 27, 28 are situated vertically over seats 21, 26.

Step 2: Opening the access door 12

Initially, the access 12 is closed. In practice the access door should generally be closed in order to protect the internal members of the machine and in particular the loading and unloading turntable 20. At the request of the operator, the electronic and computer system 600 can authorize opening of the door 12.

Step 3: Loading the lenses and the blocking accessories

The clamping jaws 22 to 25 associated with the loading housings 27, 28 are open. In practice, the two lenses 100 and 101 of the job are placed manually by the operator on the two seats 21, 26 that are accessible through the access door 12. Naturally, it is possible to envisage automatic loading of the lenses.

The blocking accessories 200, 201, 203, 204 are also placed by the operator in the loading locations 205 (FIG. 2).

Once the operator has positioned both lenses and the accessories in the carousel, the operator causes the door 12 to be closed. The jaws are then moved into the closed position so that the fingers of the jaws clamp the lenses 100 and 101.

Step 4: Reading the accessories by the RFID reader appliance

As shown in FIG. 3, the turntable 20 is turned to place the accessories 200, 201 in the reading position in the edge of the RFID reader appliance 197, one after the other.

It is verified firstly that at least two blocking accessories 200, 201, 203, 204 of the same diameter are present. For this purpose, it is assumed that if no identification data is acquired during a given length of time while the turntable 20 is in the position for reading the blocking accessories 200, 201, 203, 204, then there are no accessories on the carousel. After performing this check, the identification data of each RFID element implanted in a blocking accessory is stored.

If the verification fails, then the electronic processor unit issues a signal to warn the operator.

Optional step 5: Measuring the blocking accessories by the measuring device

When the identifier of the RFID element is unknown or when the operator informs the electronic and computer processor unit 600 that the RFID element has been given to a new accessory, then the centering and blocking device 1 proceeds to update the blocking accessory register. The electronic processor unit causes the turntable to turn so as to place the blocking accessories one after the other in position for measuring by the measuring device 5. The device performs reading followed by image processing in order to acquire the diameter of each blocking accessory. This diameter is recorded in the field provided for this purpose in the blocking accessory register.

Step 6: The measuring device 5 reading both lenses 100, 101 of the job in succession The loading and unloading turntable 20 is turned to place the first lens 100 under the measuring device 5. The measuring device 5 automatically analyzes the shape and the optical properties of the lens 100 so as to provide the electronic and computer processor unit 600 with optical power data and data relating to the frame of reference of the lens (center point and orientation), as explained above. These optical power and frame of reference characteristics are stored by the electronic and computer system 600.

In particular, by acquiring the frame of reference characteristics as mentioned above, it is possible in association with the geometrical and morphological data acquired during the above-described preliminary step, to determine the exact point where the lens 100 will be gripped and blocked once brought by the turntable into the blocking position (as explained below).

Step 7: Matching the characteristics of the lenses with the order data of the job This step serves to identify the pair of lenses being treated amongst the pairs of lenses whose characteristics have been delivered to the lens register of the electronic and computer processor unit 600. This identification of the pair of lenses being treated thus makes it possible to load into the memory all of the information relating to the pair of lenses being processed, such as the information about the desired shape, the mounting information, and the prescription information.

To this end, the electronic and computer processor unit 600 compares the measured values of the characteristics for each lens with the values of the same characteristics as recorded in the lens register, and deduces from said comparison which pairs of lenses correspond.

One method of matching (i.e. automatic identification) is described in greater detail in the patent application filed on Nov. 9, 2005 under the number FR 05/11381 in the name of the Applicant.

The electronic and computer processor unit 600 then digitally associates in the lens register the identification data of each RFID element 220 with the corresponding lens order data. As a result, the blocking accessory 200 gripped by the blocking device for applying against the lens 100 is digitally associated with the corresponding lens. As explained below, it order to identify the lenses 100, 101 and thus make use of the order data, it then suffices to acquire the identification data of the corresponding RFID element 220.

Step 8: Feeling the outlines of both lenses 100, 101 of the job in succession The loading and unloading turntable 20 is turned to place the first lens in register with the feeler device 7. The feeler fingers 92, 93 then feel the outline intended for the lens after it has been cut to shape in order to verify that the lens presents sufficient area and thickness to enable the desired shapes to be obtained after it has been shaped by the shaper device 6.

This feeling is performed by using in combination the ability of the feeler tips to move horizontally and vertically in translation and the ability of the turntable 20 to turn about the vertical axis A2.

Step 9: Feeling a plurality of points in the vicinity of the boxing center of each of the two lenses 100, 101 of the job in order to determine the normal at the boxing axis and the height position of the boxing center The boxing axis, defined above for the implementation of the invention, is then determined by feeling a plurality of points (at least three points) situated in the vicinity of the boxing center.

Step 10: Comparing the characteristics of the job with the order data

The program internal to the electronic and computer processor unit 600 then proceeds, automatically or under assistance, to validate the characteristics of both lenses 100 and 101 of the job. This validation consists in performing two verifications:

firstly individually verifying that the characteristics of each lens of the job are in compliance with the order data input by the operator; and secondly, checking that the set of characteristics for the two lenses considered as a single job is coherent, i.e. that they belong to a single pair of eyeglasses, in particular by simulating mounting both lenses on the selected frame and verifying that such mounting is indeed possible.

The characteristics for which each lens is individually validated comprise in particular:

lens type (single-vision, progressive, double or triple focus, etc.); and spherical, prismatic, cylindrical powers; power addition(s) for progressive lenses; cylinder and prism axes; tint; index; material.

The characteristics for which both lenses of the pair are considered together, as to whether they belong to the same job, are in particular:

the centering of each lens on the frame as a function of the frame of reference defined by means of the measuring device 5 for each lens and the pupillary half-distances and heights specific to the wearer, said centering serving to simulate mounting the lenses on the frame for which they are intended, as explained in greater detail below;

the axial position intended for the bevel or groove in the edge of each lens relative to the front face of the lens in order to ensure that the mounted eyeglasses will be of pleasing appearance (balanced axial positioning for both lenses, relative to each other, on the frame);

coherence in terms of tints, indices, tint variation of the two lenses of the job; and the complementarity of the two lenses, i.e. whether both lenses belong to the same job: it is verified that the job is indeed made up of a right lens and a left lens and that the two lenses do indeed correspond to the same job.

In particular, the overall comparison of the frame of reference characteristics of the job is performed as follows. Starting from information representative of the parameters specific to the morphology of the wearer, in particular the pupillary half-distance and the pupil height relative to the horizontal axis, and from information representative of the outline of the selected frame, as acquired during the above-described preliminary step, the electronic and computer system 600 generates a video image that is displayed on the LCD display screen 300. Consequently, there can be seen on the screen and at a single scale, the outline of the frame and the outline of the lens before it has been shaped, together with its particular characteristics, in particular the reference points that are marked thereon or those which are determined by using the measuring device. By taking all of these elements that have been measured, calculated, or read into account, it is possible to determine the position of the perimeter of the lens as cut to shape relative to the initial ophthalmic lens, and as a result to determine the position of the point where the lens is to be gripped for cutting purposes, which is generally the center of the rectangle circumscribing the outline of the rim of the frame.

The electronic and computer processor unit 600 then performs computer processing on said geometrical and morphological data in association with data relating to the frame of reference characteristics of the ophthalmic lenses 100, 101 of the job, taken together, in order to simulate mounting them in the corresponding rims of the selected frame, and possibly changing their centering.

It is also verified that a blocking accessory 200, 201 is present for each lens 100, 101 on the turntable 20, and that the accessory has a diameter that is compatible with the desired final outline, the desired finish, and the coating of the lens 100, 101. The electronic and computer processor unit 600 verifies in particular that placing the accessory on the boxing center will leave some minimum distance to be complied with between the desired final outline and the outside edge of the blocking accessory.

If incompatibility is found, the electronic and computer processor unit 600 requests that a different accessory be loaded or selects, after confirmation by the operator, an accessory of diameter that is better suited, in order to proceed with the final cutting to shape as a function of the shape and size desired for the lens after shaping.

The electronic and computer processor unit 600 then digitally associates the lens in the register of lenses to be treated with the identification code of the RFID element implanted in the accessory.

In this example, the blocking accessory 200 is selected for the lens 100 and the blocking accessory 201 for the lens 101.

Step 11: Accepting or refusing the job

The job is accepted or refused depending on whether the above-mentioned individual and overall characteristics are or are not satisfied and/or modified.

Alternative 1: If the job is refused, the following four steps are performed, otherwise they are ignored.

Step 12: The loading and unloading turntable 20 is turned so as to bring the job into register with the access door 12

Step 13: The jaws of the loading and unloading turntable 20 are opened

Step 14: The access door 12 is opened on command from the operator

Step 15: The job is taken by the operator and the method is reinitialized with another job Alternative 2: If the job is accepted (alternative 2 being the more probable), the four preceding steps are ignored, and the following steps are performed.

Step 16: Taking hold of and installing the blocking accessory on the lenses

To block each lens 100, 101, the loading and unloading turntable 20 is turned to place the selected blocking accessory 200, 201 under the blocking device 40 in a so-called gripping position. The gripping position is obtained by making use both of the ability of the turntable to turn about the axis A2 and the ability of the arm 42 to turn about the axis A4 so that the head 50 of the arm 42 can be placed vertically in register with the blocking accessory 200, 201.

Thereafter, the blocking device 40 is controlled by the electronic and computer processor unit 600 so that the gripper head 50 takes hold of the blocking accessory 200, 201.

The carousel 20 is turned to bring the lens 100 into position for applying the blocking accessory on the lens, under the blocking device 40. To obtain this application position, the ability of the carousel 2 to turn is combined with the ability of the arm 42 to turn so that the gripper head holding the blocking accessory is vertically in register with the boxing center.

The blocking device 40 is then controlled to apply the accessory 200 to the lens 100 with which it is associated, at the boxing center and on a properly-oriented axis.

Step 17: Turning the loading and unloading turntable 20 to present the job in register with the access door 12

Step 18: Opening the jaws of the loading and unloading turntable 20

Step 19: Opening the access door 12 on command from the operator

Step 20: The operator takes the job

The following steps are described for the lens 100 but they are also implemented with the other lens 101. The operator takes the lens 100 fitted with its blocking accessory 200 into the reading field of the RFID reader 198 placed on the cover 699 of the shaper device 6. In a variant, each lens can be taken and moved by an automatic arm.

The data for identifying the lens via the RFID element associated with the blocking accessory 200, 201 is acquired and transmitted to the electronic and computer processor unit 199 of the shaper device 6. This electronic and computer processor unit 199 of the shaper device 6 then issues a request to the electronic and computer processor unit 600 of the locator-blocker device 1 together with the identification data of the lens in order to cause the order data for the lens 100 to be delivered. The electronic and computer processor unit 600 thus acts as a server.

Step 21: Positioning the lens in the shaper device

The lens 100 fitted with its blocking accessory 200 is positioned by the operator in the grinder between the two chucks 701, 702. In particular, the blocking accessory 200 is inserted in the housing 703 of the chuck 701 which presses against the front face of the lens. As explained above, the two shafts 612, 613 are moved towards each other to clamp the lens and enable it to be rotated.

In a variant, the lens may be put into place between the two shafts 612, 613 by means of an automatic arm.

Step 22: Machining (cutting to shape) the first lens 100 of the job by the shaper device 6

The electronic and computer system 199 controls the shaper device 6 so as to machine the periphery of the lens in such a manner as to shape said periphery to have the desired outline, given the frame of reference characteristics for the lens as supplied by the measuring device 5 and the data concerning the morphology of the wearer and the shape of the frame as entered into memory.

Depending on the type of frame for which the job being treated is intended (rimmed frame, rimless frame with lenses being drilled, frame using Nylon string), the lens is beveled, drilled, or grooved. In this example the frame has a rim so the lens is beveled.

During machining, the end of each machining step is written in a field flagging the state of treatment applied to the lens in question of the job.

Step 23: Updating job state

Once the lens has been cut to shape, the electronic processor unit 199 of the shaper machine enters into communication with the server locator-blocker device so that it updates a field flagging the treatment state of the job or of each of the two lenses in the job in the lens register. This field is then modified to contain a flag indicating that the job and one and/or the other of the two lenses in the job is or have been cut to shape.

Optional step 24: Subsequent reworking of the lens

It can happen that a lens that has been shaped is slightly too large and cannot be mounted correctly in the surround of the frame for which it is intended. Under such circumstances, it is necessary subsequently to rework the lens by retouching its periphery in order to enable it to be mounted. Under such circumstances, the RFID element of the lens blocking accessory, which accessory has remained attached to the lens, is read by the RFID reader of the shaper machine and the electronic processor unit 199 of the shaper machine enters into communication with the electronic processor unit 600 of the server locator-blocker device to recover the data relating to the lens associated with said RFID identifier. This data includes the data needed for the reworking operation itself, and also information about the state of the lens or of the job.

Thus, if the lens to be treated has already been shaped, the electronic processor unit 199 of the shaper machine automatically calls up a mode for reworking the shaping.

This automatic use of the mode for reworking the shaping makes it possible to avoid a handling error by the operator.

When manually inputting the desired shaping mode, an operator may desire to perform reworking even though the lens presented to the grinder is a different lens that has not yet been shaped. Such a lens, if shaped while performing reworking mode, would have to be discarded.

Thus, subsequent reworking is automatically identified as such, thus enabling reworking mode to be called up automatically.

The invention is not limited to the particular embodiment described above, but on the contrary covers any variant that uses its essential characteristics. For example, the matching step during which the lens and the job to which it belongs are identified on the basis of their optical characteristics could be omitted. Under such circumstances, an initial step is provided during which the optician or the operator identifies the job to which the lenses installed on the locator-blocker device belong, e.g. by selecting from a list of jobs present in the lens register of the locator-blocker device or the server device. The left and right lenses then need to be installed in loading housings that are specifically attributed thereto.

In addition, the shaper device and the locator-blocker device need not be mounted on a common frame, but could be physically spaced apart from each other.

The RFID reader present on the centering and blocking device 1 and/or the shaper device could be used for identifying the operator or the technician in charge of the after-sale service by means of a badge including an RFID element with an identification code specific to the operator or the technician. A trace of the actions undertaken can then be kept by computer on a local or remote database server.

What is claimed is:

1. A method of preparing eyeglass lenses for mounting in the frame selected by the wearer, taking account of stored mounting parameters associated with the morphology of the wearer and with the shape of the frame, the method comprising the following steps:

a "centering" first step during which the optical frame of reference of the lens is acquired and a blocking accessory is appropriately positioned in the optical frame of reference of the lens; and a second step of shaping the lens to have a desired outline in a frame of reference associated with the blocking accessory and thus the optical frame of reference of the lens, with account being taken of the mounting parameters, wherein the blocking accessory is fitted with an electronic identification element bearing an identification code, and said identification code of the electronic element is read initially during a first read during the centering step to associate the code in memory with the mounting parameters of the lens that is receiving the blocking accessory and with an indication as to whether the lens in question corresponds to the right eye or the left eye of the wearer, and then during a second read during the shaping step in order to recover the mounting parameters and said indication associated with the identification code as read and thus with the lens attached to the blocking accessory.

2. A method according to claim 1, wherein after the step of shaping the lens, the identification code of the electronic element fitted to the blocking accessory attached to the shaped lens is associated in memory with an indication that the lens in question has been shaped.

3. A method according to claim 1, wherein on the basis of the identification code read during the first read, a search is made in a register of blocking accessories, for at least one geometrical or mechanical characteristic of the blocking accessory fitted with the electronic element carrying the identification code that has been read, and it is verified that said geometrical or mechanical characteristic of the blocking accessory is compatible with the mounting parameters.

4. A method according to claim 3, wherein said characteristic of the blocking accessory includes a dimension of said blocking accessory.

5. A method according to claim 1, wherein said electronic element is a radio frequency identification element.

6. A method of preparing eyeglass lenses for mounting in the frame selected by the wearer, taking account of stored mounting parameters associated with the morphology of the wearer and with the shape of the frame, the method comprising the following steps:

a "centering" first step during which the optical frame of reference of the lens is acquired, during which a blocking accessory is appropriately positioned in the optical frame of reference of the lens, and during which a geometrical or mechanical characteristic of the blocking accessory is acquired; and a second step of shaping the lens to have a desired outline in a frame of reference associated with the blocking accessory and thus the optical frame of reference of the lens, with account being taken of the mounting parameters, wherein the blocking accessory is fitted with an electronic identification element bearing an identification code, and said identification code of the electronic element is read initially during a first read during the centering step to associate the code in memory with the mounting parameters of the lens that is receiving the blocking accessory, and then during a second read during the shaping step in order to recover the mounting parameters associated with the identification code as read and thus with the lens attached to the blocking accessory, and in order to check that said geometrical or mechanical characteristic of the blocking accessory is compatible with the mounting parameters.

7. The method according to claim 6, wherein following the first read, the identification code of the electronic element fitted to the blocking accessory associated with the lens is associated in memory with an indication as to whether the lens in question corresponds to the right eye or the left eye of the wearer.

8. The method according to claim 6, wherein after the step of shaping the lens, the identification code of the electronic element fitted to the blocking accessory attached to the shaped lens is associated in memory with an indication that the lens in question has been shaped.

9. The method according to claim 6, wherein on the basis of the identification code read during the first read, a search is made in a register of blocking accessories, for at least one of the geometrical or mechanical characteristic of the blocking accessory.

10. The method according to claim 9, wherein said characteristic of the blocking accessory includes a dimension of said blocking accessory.

11. The method according to claim 6, wherein said electronic element is a radio frequency identification element.

* * * * *

UNITED STATES PATENT AND TRADEMARK OFFICE

CERTIFICATE OF CORRECTION

PATENT NO. : 7,563,153 B2
APPLICATION NO. : 11/844367
DATED : July 21, 2009
INVENTOR(S) : Ahmed Haddadi It is certified that error appears in the above-identified patent and that said Letters Patent is hereby corrected as shown below:

On the title page, please amend item (73) to read as follows:

--(73) Assignee: Essilor International (Compagnie Generale d'Optique), Charenton-le-Pont (FR)--.

Signed and Sealed this

First Day of September, 2009

David J. Kappos

David J. Kappos
*Director of the United States Patent and Trademark Office*